United States Patent [19]

Hergeth et al.

[11] 4,040,948

[45] Aug. 9, 1977

[54] DEVICE FOR CLEANING FLOCK FORMED BY NATURAL FIBERS, ESPECIALLY COTTON FLOCK, OF DIRT PARTICLES

[75] Inventors: Herbert Hergeth; Walter Wirth, both of Dulmen, Germany

[73] Assignee: Hergeth KG Maschinenfabrik und Apparatebau, Germany

[21] Appl. No.: 585,859

[22] Filed: June 11, 1975

[30] Foreign Application Priority Data

June 27, 1974 Germany ..... 2431018

[51] Int. Cl.[2] ..... B07B 9/00

[52] U.S. Cl. ..... 209/22; 19/200; 209/250; 209/293

[58] Field of Search ..... 19/89, 200, 202–205, 19/156.3, 156.4, 66 R; 68/DIG. 5; 209/21, 22, 250, 295, 472, 293; 34/115, 60

[56] References Cited

U.S. PATENT DOCUMENTS

| | | | |
|---|---|---|---|
| 41,487 | 2/1864 | Craven | 19/156.4 X |
| 1,509,359 | 9/1924 | Lawson | 19/66 R X |
| 2,810,163 | 10/1957 | Kyame et al. | 19/205 X |
| 2,835,047 | 5/1958 | Fleissner et al. | 34/115 X |
| 2,996,808 | 8/1961 | Fleissner | 68/DIG. 5 X |
| 3,196,555 | 7/1965 | Friedel et al. | 34/115 |
| 3,413,727 | 12/1968 | Fleissner | 34/115 X |
| 3,686,903 | 8/1972 | Fleissner | 68/DIG. 5 X |
| 3,818,607 | 6/1974 | Fleissner | 34/115 |

FOREIGN PATENT DOCUMENTS

| | | | |
|---|---|---|---|
| 866,596 | 4/1961 | United Kingdom | 34/115 |

*Primary Examiner*—Dorsey Newton
*Attorney, Agent, or Firm*—Diller, Brown, Ramik & Wight

[57] ABSTRACT

This disclosure relates to apparatus for cleaning natural fibers of their contaminants by passing the same through a pair of rotary drum sieves each having a porous peripheral surface subject to a vacuum whereby natural fibers adhere to the porous peripheral surfaces and contaminants are drawn therethrough, the drum sieves being disposed with portions of their peripheral surfaces defining a throat through which the fibers pass, and means contiguous the throat for cutting off the vacuum effect of the first drum sieve whereby the fibers are transferred from the first drum peripheral surface to that of the second drum.

2 Claims, 5 Drawing Figures

DEVICE FOR CLEANING FLOCK FORMED BY NATURAL FIBERS, ESPECIALLY COTTON FLOCK, OF DIRT PARTICLES

The present invention relates to apparatus for cleaning flock formed of natural fibers, particularly cotton flock, by removing therefrom dirt particles, fiber dust, fiber particles, seed husk particles, and like contaminants by means of rotating vacuum drum sieves.

With the introduction of open-end spinning drastic changes have taken place in not only the technique of yarn formation, but also in the technology of fiber preparation. The qualitative properties of open-end spun yarns, apart from their reduced strength (particularly with carded short staple cottons) indicate that they are superior to ring-spun yarns, specifically in their uniformity, their reduced numbers of neps, slubs thin points, and also in their weaving and knitting properties. For these reasons lower classes of cotton (so-called low grades) may be satisfactorily used in open-end spinning technology. However, a necessary condition for such usage is the presence of an extended band of high purity and uniformity of fibers.

An open-end spinning system produces yarn by means of a rotary spinning chamber which has a fiber collecting surface and a recess for yarn formation. Such rotary chambers for short-stapled fibers have a diameter of about 40–60mm and revolve at a speed of about 30,000 to 90,000 r.p.m. In one such system the rotary chamber has intrinsic ventilation through a ring of holes for transporting fibers from a combing-out roller to the chamber. The enormously high rotary speeds of the rotor gives rise to intense centrifugal forces which lead to deposits of fine and microfine fiber dust in recesses of the chamber.

It has been found that in the processing of cotton deposits of fiber dust and other foreign particles form in the recesses of the spinning chamber and in the system latter-described having a ring or holes in the rotor. The degree of dirt in the chambers varies with the processing of different types of cotton. Obviously dirt in the chambers can substantially impair the uniformity of the yarn and at certain degrees of build-up leads to thread breakage. When there is only a local concentration of dirt in the chambers there then results the known undesirable moire effect in the yarn. The time for dirt to build-up to such an extent as to impair the yarn quality or lead to yarn breakage is dependent upon the quality of the supply of the processed cotton and on the degree of effectiveness of cleaning the cotton in the cleaning and carding machines prior to the introduction thereof into the rotary chamber. Depending upon the latter and similar factors dirt build-up sufficient to impair operations and accordingly cotton quality can occur as rapidly as within two hours of rotation of the rotary chamber and most certainly within twenty operational hours, thus differing according to cotton quality in a ratio of about 1:10.

It has been conventional to provide open-end spinning machines with dirt separators at the combing-out roller. This separator in combination with a feed cylinder pre-opener with striker edges and an outlet duct achieves a separation of hard and relatively heavy dirt particles by centrifugal force. A counter flow caused by a low pressure in the removal duct prevents the separation of fibers but also prevents the removal of light dust, dirt, and other contaminants. Therefore the risk of deposits of fine dust in the recess of the spinning chamber is not eliminated and there remains a requirement for more exacting separation of fibers from contaminants than theretofore provided.

Dust, dirt, loose particles, and similar contaminant problems as those mentioned heretofore in connection with open-end spinning processes do not occur in a ring-spinning process. In the latter it is sufficient to pulverize the dirt particles with a squeeze roller after the carding process and in subsequent steps the dirt is separated in the drafting and roving as well as by the balloon formation at the ring-spinning machine.

Microscopic analysis of dust in a rotary spinning chamber leads to the conclusion that dirt fragments are involved which are smaller than 0.6mm and usually smaller than 0.3 and 0.15 mm in diameter. In addition to this fine and microfine dust which is too small to be separated by conventional cleaning processes, fiber dust particles, broken fiber particles, microfine to medium-sized seed husk portions, microfine foliage leaf particles and somewhat coarser dirt is also found in the chamber, such as wood particles and foliage particles. Thus the task is to remove all of these impurities or contaminants to achieve a very high degree of purity and above all a very high degree of dust-removal from the flock in order to avoid disturbances in the chamber. These disturbances in the rotor not only impair the yarn quality, but also the degree of operating efficiency of these high performance spinning machines by the necessity of frequently cleaning the chamber and the high number of thread breakages.

In keeping with the foregoing it is a primary object of this invention to reduce the considerable costs involved in removing dust from cotton and other natural fibers by utilizing at least two rotary drum sieves whose interiors are connected to a source of vacuum with the drums being so arranged that in use flock fed to the outer peripheral surface of one drum sieve is held thereon by suction, rotates with the sieve, and then is discharged onto the other drum sieve while dirt particles are sucked into the interior of the sieves with the sieves being driven in opposite directions and the vacuum being broken or interrupted at the transfer area of the flock between the drum sieves.

In further accordance with this invention the efficiency of the cleaning operation is doubled by the fact that the band of flock has dust and dirt removed from one side by one drum sieve and from the other side by the other drum sieve due to the opposite directions of rotation of the drum sieves. When several sets of drum sieves are incorporated in such succession a very large percentage of fine and microfine dust is removed from the cotton flock and under the influence of centrifugal force is incapable of being deposited upon the rotary spinning chambers. Thus, the efficiency of open-end spinning machines and the quality of the yarn produced are considerably improved.

In further accordance with this invention the drum sieves each consisting of two drum sieves slightly offset one from the other may be arranged vertically above one another, vertically offset, horizontally, or diagonally with the vertical or vertically-offset arrangement being the most advantageous due to its compactness and ability to be attached to an open-end spinning machine. The throughput of the flock or fiber can be effected preferably from top to bottom but may be from bottom to top.

In the case of the mutual offsetting of the sets of sieves or drums an advantage achieved is that a minimum amount of the sieve area is utilized as a so-called working surface or suction surface and the dust evacuation performance on the flock is improved.

In further accordance with this invention the vacuum of the sieves is cut-off at transfer or throat areas between adjacent drum sieves so that a continuous generally uniformed thickness strip of fiber or flock is transferred continuously through the machine during the cleansing thereof.

In further accordance with this invention there is disposed between two drum sieves or between two sets of drum sieves an opener or brush roller adjacent the discharging sieve and spaced a predetermined distance from the next following sieve in order to enable the free fall of the flock or the flakes of flock. The purpose and advantage of the opener or brush roller is that after the flock band has been vacuum cleaned on both sides by two sieves of a set it is intensively opened, fluffed and loosened in order that it may pass to the next set of drum sieves in the form of flakes and is exposed in this opened condition to the suction effect for the additional removal of dust from its sides. The rollers for loosening, fluffing or opening the flock or fibers which are condensed by the suction or vacuum effect may be brushes, pin rollers, beaters, rollers fitted with saw teeth, or any other type of opening device.

In further accordance with this invention a discharge zone of a drum sieve or a set of drum sieves is provided with at least one take-off roller in advance of an opener or beater roller which preferably has ribs or saw teeth. The ribbed or saw toothed roller is positioned in a discharge trough and the cotton flock is opened or loosened as it is pressed by the roller against the trough and is thus intensively combed-out to achieve homogeneous fine opening and better dust removal upon the subsequent feeding of the flock flakes to subsequent drum sieves.

In further accordance with this invention the successive peripheral porous surfaces of the sieves may have a hole diameter or mesh graded from drum to drum from coarse to fine. Also, various free hole surfaces or levels may be provided for better adaptation to the degree of dust removal and opening of the flock. In this way undesirable loss of so-called "good fibers" is kept at a minimum. The hole diameter of the first sieve can, for example, be 3.5mm. that of the second drum 3.0mm, and that of the third and fourth drums 2.8mm, or the mesh width may be graded from 0.8mm to 0.5mm to 0.3mm, from coarse to fine.

In successive drum sieves, the degree of vacuum can be varied or can be kept at the same intensity, and preferably the vacuum is achieved by a single blower for identical vacuum intensity and separate blowers if there is to be a variance in the degree of vacuum.

In keeping with one arrangement of this invention a pair of drum sieves are connected at one axial end to a drive and at an opposite axial end are placed in fluid communication with a suction fan. This permits a multiplicity of sets of drum sieves to be interconnected in a simple manner at varying degrees of vacuum intensity.

In order to generate a uniform vacuum throughout the axial length of each drum sieve both axial ends of each drum may be opened and each opened end placed in fluid communication with a common duct or manifold connected to a suction fan. In this manner a vacuum is equally drawn through opposite axial ends of each drum sieve and the flock upon the porous peripheral surface thereof is more uniformally distributed resulting in better cleaning, dust removal, and a uniformed thickness of the cotton or like flock or fiber.

In order to achieve different cleaning effects appropriate to the type and quality of the fibers the rotary speeds of the successive drum sieves may be identical or may be progressively faster. Even small distances in speed between the drum sieves in such a way that the take-up sieve rotates slightly faster than the discharging sieve causes a thinning of the cotton layer so that a deeply intensive dust removal can be achieved in relation to the fiber layer thickness.

With the above and other objects in view that will hereinafter appear, the nature of the invention will be more clearly understood by reference to the following detailed description, the appended claimed subject matter, and the several views illustrated in the accompanying drawings.

IN THE DRAWINGS

Figure 1:
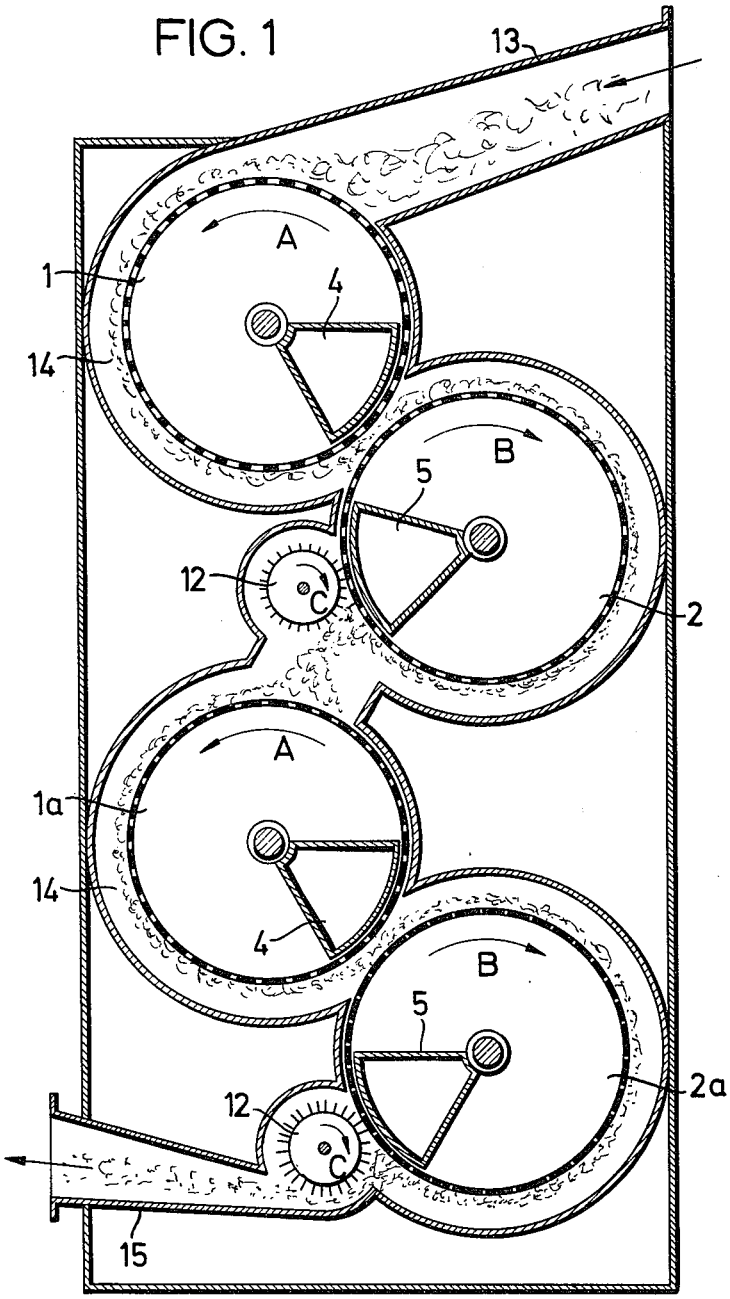
FIG. 1 is a schematic vertical sectional view of a novel cleaning apparatus constructed in accordance with this invention, and illustrates two pairs of rotating drum sieves for cleaning flock as it passes along porous peripheral surfaces thereof from an inlet to an outlet.
Figure 2:
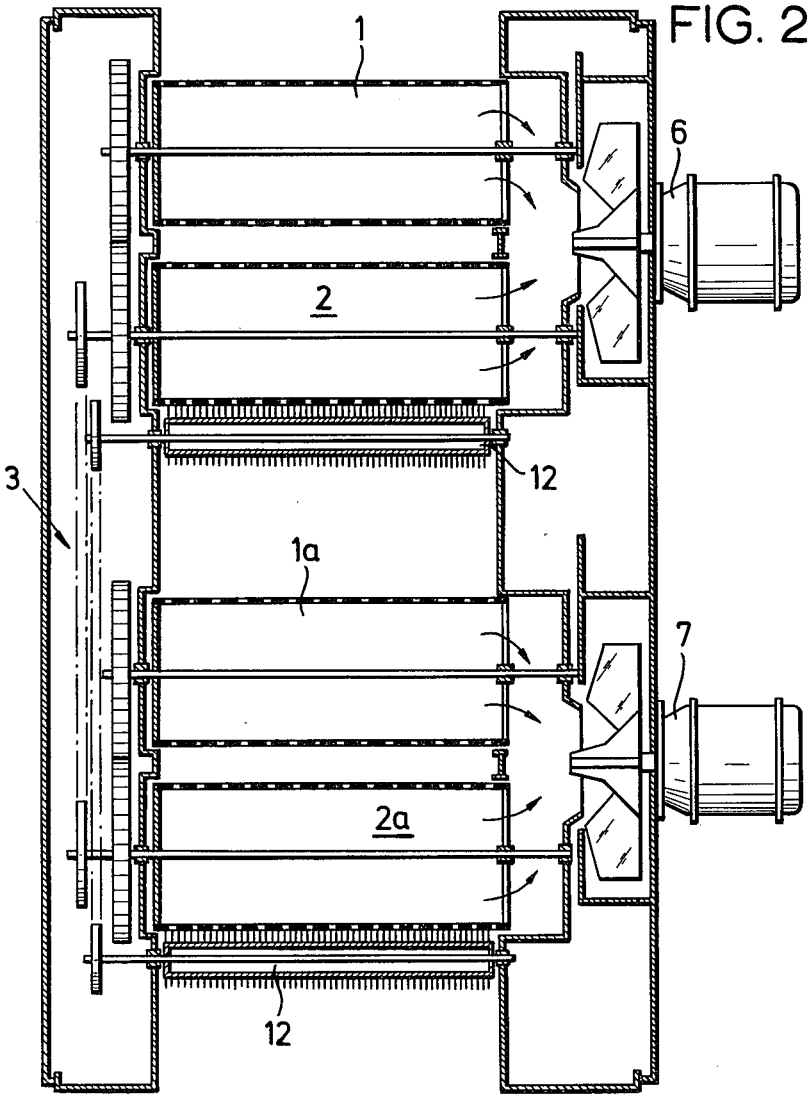
FIG. 2 is a vertical front sectional view of the apparatus of FIG. 1, and illustrates the manner in which pairs of drum sieves are driven or rotated at one side thereof and a vacuum is drawn through an opposite side thereof.

Referring first to FIGS. 1 and 2 of the drawings, apparatus for cleaning flock formed from natural fibers, for example, cotton flock, of dirt particles, such as fiber dust, broken fiber particles and seed husk particles consists of two sets of drum sieves set vertically one above the other. An upper set of drum sieves is formed of a first drum sieve 1 and a second drum sieve 2 while a lower set or pair of drum sieves includes a first drum sieve 1*a* and a second drum sieve 2*a*. The drum sieves 1, 2 rotate in opposite directions as do the drum sieves 1*a*, 2*a*, as indicated by the arrows A, B associated therewith. The rotary speed of the successive drum sieves 1, 2, 1*a*, 2*a*, respectively, may be the same or may increase in the direction of feed which is from top to bottom, as viewed in FIG. 1, again as indicated by the directional arrows A, B.

Means for imparting rotation to the drum sieves is achieved by a conventional drive system 3 (FIG. 2) provided at an axial end of each of the drum sieves 1, 2, 1*a* and 2*a*. Each drum sieve 1, 2, 1*a* and 2*a* is preferably a perforated or porous peripherally extending plate with holes or formed as a woven wire fabric of a suitable mesh size as, for example, 2 to 4mm in diameter.

Figure 3:
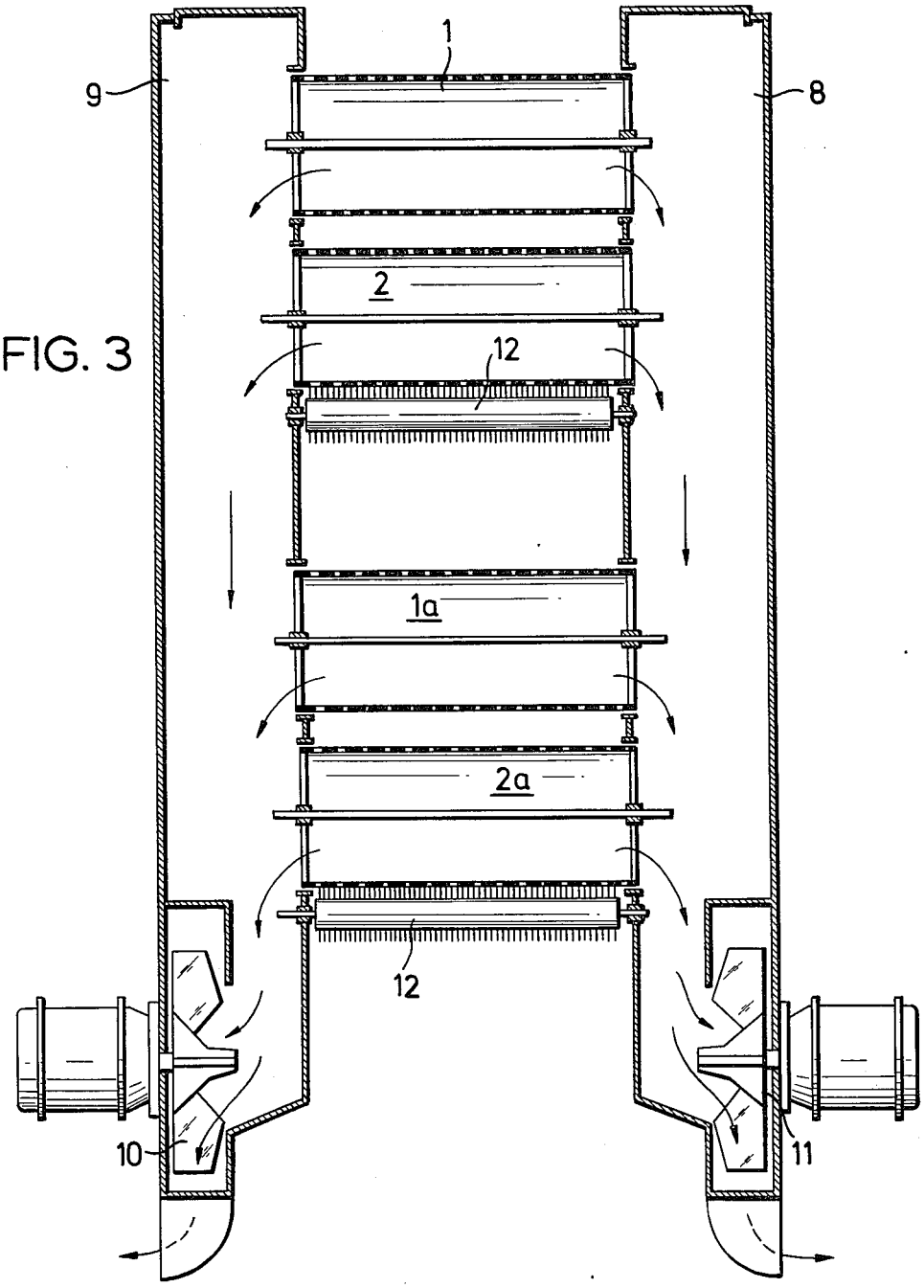
FIG. 3 is an alternate embodiment of the invention, and illustrates the manner in which a vacuum is drawn through axially opposite ends of all drum sieves through common manifolds.

In a zone of transfer from the first drum sieve 1 or 1*a* to the second drum sieve 2 or 2*a*, respectively, there are provided means interiorly of the drums in the form of sealing shields 4 and 5 which cover part of the peripheral surface of each drum in a throat or transfer zone between the drums in order to cut-off or reduce suction maintained in the interior of each drum so that it is shielded so that flock discharged from the drum 1 in the area of the shield 4 may be readily picked-up by the drum 2. Likewise, flock discharged from the drum 2 in the area of the shield 5 is readily discharged upon the drum 1*a*, etc. The vacuum or suction is on the order of 50 to 200mm water-column and is generated by suction fans or suction blowers 6, 7 (FIG. 2) which draw air through the opened ends (unnumbered) of the drum sieves 1, 2, 1*a*, 2*a*. The suction fans 6, 7 may generate the same or different degrees of suction to be selected in dependence upon the material being cleaned. Alternatively, in the embodiment shown in FIG. 3 both axially opposite ends of each drum sieve 1, 2, 1*a* and 2*a* are opened and are connected to common ducts or manifolds 8, 9, which are under the effect of suction fans 10, 11. The latter construction achieves a more uniformed vacuum force over the entire peripheral surface of the drum sieves to achieve a uniformed thickness of the flock transported and cleaned thereby.

At the discharge end of each set of drum sieves, generally in the area of the vacuum cut-off means 5, there is provided an opener or brush-roller 12 (FIG. 1) which rotates in the direction of the arrow C which is opposite to that of its associated drum sieve 2 or 2*a*. The drive for this opener or brush-roller 12 may be likewise derived from the drive mechanism 3 (FIG. 2).

The apparatus operates upon flock 14 delivered through a chute 13 toward the first drum sieve 1 which is rotating in a counter-clockwise direction as viewed in FIG. 1 and is under the influence of an internal vacuum. As a result dust and dirt is primarily received from the side of the flock 14 most adjacent the peripheral surface of the drum sieve 1 and the fiber or flock is condensed against the peripheral surface by the vacuum. The dust partially cleansed and condensed layer 14 of the flock or fiber passes through a bight or throat area between the drums 1, 2 and the vacuum cut-off means 4 which forms a shield to preclude the vacuum effect in the throat area releases the layer 14 from the drum sieve 1 which is then drawn against the peripheral surface of the drum sieve 2, and this process is repeated as the flock continues its passage through the apparatus and the remaining drum sieves 1*a*, 2*a*. As a result of the offset positioning of the drums 1 and 2 relative to one another and their opposite directions of rotation the layer 14 thereby follows an S-shaped path and has the dust removed first on one side by the drum sieve 1 and then on the other side by the drum sieve 2. Delivery of the layer 14 from the drum 1 to the drum 2 is effected without or with only a small difference in speed of both drums and thus almost at the same layer thickness, i.e., the cotton's composition is practically unaffected during this transfer.

In order to pass the layer 14 which has been de-dusted on both sides by the drum sieves 1 and 2 collectively in an optimum condition for further cleansing the opener or brush-roller 12 located at the discharge point of the drum 2 in the area of the vacuum cut-off means 5 rotates and thus intensively loosens up the condensed flock layer 14 so that it passes in the form of small flakes in free fall or in an air flow to the drum sieve 1*a* of the next drum set and is hereagain subject to vacuum de-dusting or cleansing on both of its sides by the two drum sieves 1*a*, 2*a*. At the discharge point of the drum sieve 2*a* there is also located in the area of the vacuum cut-off means 5 another opener or brush-roller 12 which loosens the compressed flock layer 14 so that it passes in flake form through a suction nozzle 15 to further units.

It is necessary to flake the finally cleansed fiber flock prior to being fed for further treatment, and in lieu of the last brush-roller 12 there may be employed a take-off roller 17 (FIG. 4) which has saw teeth on its peripheral surface or is ribbed and rotates in a manner to press the flock layer 14 removed from the drum sieve 2*a* against a trough 16 toward an opener or beater roll 18, the latter of which intensively combs-out and subjects the flock layer to a homogeneous fine opening or fluffing before it passes to a subsequent drum sieve or to further processing units.

Figure 4:
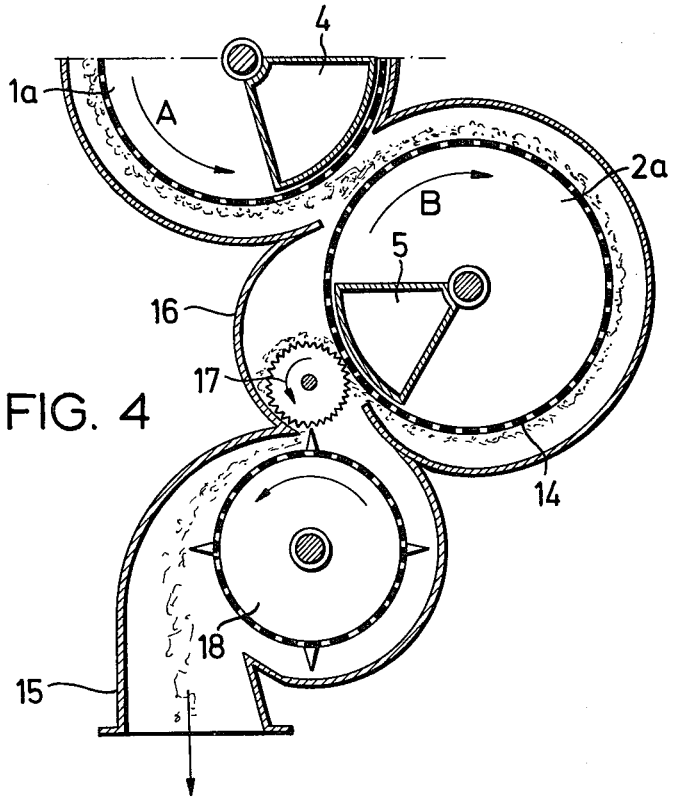
FIG. 4 is a fragmentary sectional view of another embodiment of this invention, and illustrates a discharge sieve followed by a take-off roller which in turn is followed by an opener or beater roller adjacent a discharge trough.
Figure 5:
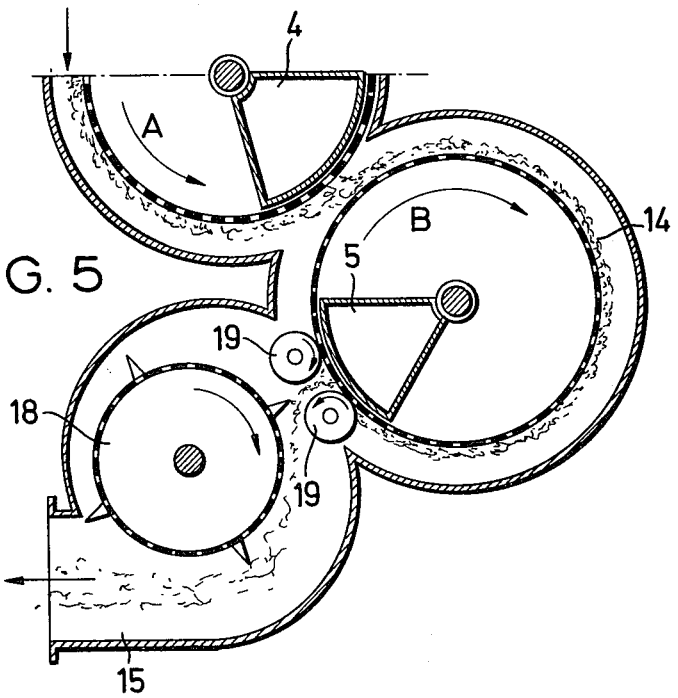
FIG. 5 is a view similar to FIG. 4, and illustrates in lieu of the take-off roller 17 a pair of take-off rollers 19 rotating oppositely each other.

In the embodiment of the invention illustrated in FIG. 5 the saw tooth take-off roller 17 of FIG. 4 is replaced by two take-off rollers 19 which rotate opposite to each other and press the flock layer 14 therebetween so that a subsequent opener or beater roller 18 can carry out an intensive fine opening or fluffing of the flock strip before it is conveyed through an output nozzle 15 to further drum sieves or other processing units.

While preferred forms and arrangement of parts have been shown in illustrating the invention, it is to be clearly understood that various changes in details and arrangements of parts may be made without departing from the scope and spirit of this invention.

We claim:

1. Apparatus for cleaning natural fibers by removing therefrom particles of dirt, fiber dust, broken fiber particles and like contaminants comprising a pair of rotary drum sieves each having a porous peripheral surface, means for rotating said drum sieves in opposite directions, means for feeding natural fibers to a first of said drum sieves, means for drawing a vacuum within each drum sieve whereby natural fibers adhere to said porous peripheral surfaces and contaminants are drawn through said porous peripheral surfaces, said drum sieves being disposed with portions of their peripheral surfaces defining a throat through which the fibers pass, means only at and contiguous said throat for cutting off the vacuum effect of said first drum sieve porous peripheral surface at said throat whereby the fibers are transferred from said first drum sieve to the second drum sieve whereby due to the opposite rotation of said drum sieves contaminants are withdrawn from opposite sides of said fibers as they pass along said pair of drum sieves, means for removing fibers from the porous peripheral surface of said second drum sieve, said fiber removing means being a roller rotating in a direction opposite to that of said second drum sieve, and the porosity of the porous peripheral surface of an upstream one of said drum sieves is greater than the porosity of the porous peripheral surface of a downstream one of said drum sieves.

2. Apparatus for cleaning natural fibers by removing therefrom particles of dirt, fiber dust, broken fiber particles and like contaminants comprising a pair of rotary drum sieves each having a porous peripheral surface, means for rotating said drum sieves in opposite directions, means for feeding natural fibers to a first of said drum sieves, means for drawing a vacuum within each drum sieve whereby natural fibers adhere to said porous peripheral surfaces and contaminants are drawn through said porous peripheral surfaces, said drum sieves being disposed with portions of their peripheral surfaces defining a throat through which the fibers pass, means only at and contiguous said throat for cutting off the vacuum effect of said first drum sieve porous peripheral surface at said throat whereby the fibers are transferred from said first drum sieve to the second drum sieve whereby due to the opposite rotation of said drum sieves contaminants are withdrawn from opposite sides of said fibers as they pass along said pair of drum sieves, means for removing fibers from the porous peripheral surface of said second drum sieve, said fiber removing means being a roller rotating in a direction opposite to that of said second drum sieve, another pair of rotary drum sieves each having a porous peripheral surface, means for rotating said another pair of drum sieves in opposite directions, a first of said another pair of drum sieves being disposed between a second of said another pair of drum sieves and the second drum sieve of said first-mentioned pair of drum sieves to receive the fibers removed from said second drum sieve of said first mentioned pair of drum sieves said vacuum drawing means including a manifold common to both pairs of drum sieves, and the porosity of the porous peripheral surface of an upstream one of said drum sieves is greater than the porosity of the porous peripheral surface of a downstream one of said drum sieves.

* * * * *

UNITED STATES PATENT AND TRADEMARK OFFICE

CERTIFICATE OF CORRECTION

PATENT NO. : 4,040,948

DATED : August 9, 1977

INVENTOR(S) : Herbert Hergeth and Walter Wirth

It is certified that error appears in the above-identified patent and that said Letters Patent are hereby corrected as shown below:

On the abstract page, the address of the Assignee should fully read:

- - Dülmen i.w., West Germany

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*